United States Patent [19]

Glucksman

[11] Patent Number: 4,694,142

[45] Date of Patent: Sep. 15, 1987

[54] ELECTRIC AIR HEATER

[76] Inventor: Dov Z. Glucksman, 1578 Beacon St., Brookline, Mass. 02146

[21] Appl. No.: 676,277

[22] Filed: Nov. 29, 1984

[51] Int. Cl.[4] ..... F24H 7/00

[52] U.S. Cl. ..... 219/371; 219/369; 219/373

[58] Field of Search ..... 219/370, 369, 371, 373, 219/365, 368; 338/58, 294

[56] References Cited

U.S. PATENT DOCUMENTS

| | | | |
|---|---|---|---|
| 2,011,856 | 8/1935 | Harrison et al. | 219/371 X |
| 2,221,703 | 11/1940 | Falco | 219/365 X |
| 3,807,495 | 4/1974 | Skarecky | 219/365 X |
| 4,034,204 | 7/1977 | Windsor et al. | 219/365 X |
| 4,090,061 | 5/1978 | Glucksman | 219/368 X |

*Primary Examiner*—E. A. Goldberg
*Assistant Examiner*—M. M. Lateef
*Attorney, Agent, or Firm*—John S. Roberts, Jr.

[57] ABSTRACT

An electric forced-convection air heater consisting of an axial fan and a cage-shaped resistance heating element mounted up-stream of the fan impeller, which serves to heat the air passing there through and to guide the air stream smoothly to the impeller. The cage shaped resistance heating element comprises a plurality of spaced longitudinal strips of uniform width, extending parallel to the axis of the cage; the surface of each strip is inclined to the ideal cylindrical surface of the cage and is curved perpendicular to its long axis. The alternate ends of the adjacent strips are jointed by bridging portions of the same material, but of larger cross section. Each bridging portion is perforated by a small opening. The cage is rigidly held in its cylindrical shape by two end rings of a thermoplastic material, provided with outstanding lugs on their circumference, one lug each engaging with one of the openings in the bridging portion atop each end of the cage.

14 Claims, 11 Drawing Figures

ELECTRIC AIR HEATER

MATERIAL INFORMATION DISCLOSURE

The following U.S. patents are considered as prior art: U.S. Pat. Nos. 2,011,856, 2,221,703 and 4,090,061.

BACKGROUND OF THE INVENTION

The invention relates to an electric forced-convection air heater suitable for permanent attachment to a wall or a ceiling, or as a free-standing room heater. It refers particularly to an electric air heater provided with an axial fan and an electric resistance heater mounted upstream of the fan impeller.

Most forced-air heaters of known design employ as heating elements coils of resistance wires suspended from ceramic supports which, in turn, are held in position by a metal structure. This kind of heating element is very labor intensive, since the coils have to be threaded through openings in the ceramic supports, a task which is necessarily carried out by manual labor.

Another kind of resistance heater consists of individual strips of a resistance alloy, threaded at their both ends into perforations of ceramic support members. The projecting ends of the strips are subsequently connected to an electric power source by soldering or clamping. It will be understood that this assembly is highly labor intensive and therefore, expensive.

Finally, my U.S. Pat. No. 4,090,061 discloses a resistance heater surrounding a centrifugal blower impeller and serving both as air heater and as outlet guide vanes. The heater is in form of a cage of parallel vanes which are at their alternate ends connected to the adjacent vanes by bridging pieces. The cage is positioned in circular recesses in opposite walls of the blower casing and held therein by friction and pressure. The manufacture of this heating element is labor-saving, but the position of the individual vanes in relation to each other and to the blower casing is not very exact and stable, frequently resulting in changes of the angle of incidence and of the spacing of adjacent vanes.

SUMMARY OF THE INVENTION

It is the object of the present invention to provide an electric forced-convection air heater consistent of an axial fan and a cage-shaped heating element upstream of the fan impeller, which should serve to heat the air passing therethrough and to guide the air stream smoothly to the impeller, with the aim to reduce the flow resistance of the heater elements to a minimum, thereby lowering the noise level of the appliance and to increase its efficiency.

It is a further object of the invention to provide a resistance heater of a rigid construction and of simple design which should lend itself to manufacturing at low cost.

Still another object is to obviate the brittle and expensive ceramic supports utilized in most conventional heaters and made necessary by the high temperatures experienced, and to use, in their stead, supports from a plastic material which are simple to manufacture and can be readily assembled without danger of breakage.

And it is a final object to provide an axial fan unit and a resistance heater of standard design, which can be used together with a considerable number of casing designs for different heating purposes.

The forced convection air heater according to the invention, consists essentially of an axisymmetrical casing containing an electric motor and an axial impeller, a cage shaped resistance heater, surrounding the electric motor at a predetermined distance, both the motor and heater being in axisymmetrical alignment. The unit likewise contains means for electrically energizing the electric motor and the heater, and means for controlling the current supply to the heater as a function of the air temperature.

In a preferred embodiment of the air heater the fan casing comprises a rigid back plate, a front portion perforated by air outlet openings, and a peripheral portion containing air inlet openings. The fan motor is firmly connected to the back plate in coaxial alignment with the casing, and an impeller is firmly mounted on the motor shaft, facing the outlet openings in the front portion of the casing.

The resistance heater is in the form of a cage fastened in a peripheral gap of the casing upstream of the fan impeller; it comprises a plurality of spaced, longitudinal strips of an electric resistance alloy in sheet form, all strips being of uniform width and extending parallel to the axis of the cage; the surface of each strip is inclined to the surface of the cage and is curved perpendicular to its long axis. The alternate ends of adjacent strips are jointed by bridging portions of the same material, but of larger cross section, whereby current density becomes much less than in the strips and causes the bridging portions to remain relatively cool. Each bridging portion is perforated by an opening of preferably rectangular shape, all bridging portions and all openings being of identical shape and location in regard to the conductive strips.

The cage is rigidly held in its predetermined shape by two end frames of a thermoplastic material which have an outside perimeter coextensive with the inside of the metal cage and are provided with outstanding lugs on their circumference, one lug each engaging with one of the openings in the bridging portions at each end of the cage. For the purpose of firmer engagement the ends of the lugs are molten down on the bridging portions by heating after assembly, thus preventing any movement of the connected parts due to thermal expansion or vibrations.

Electric terminals, a thermo-fuse and a theremostatic limit switch are preferably mounted on one of the end frames.

With a view to obtaining a strong cage at low cost, the entire cage including the strips and the bridging are cut and formed from a single sheet of resistance alloy by means of manufacturing processes known to the art. The bridging portions lie in one common plane initially, while the strips are bent, all in the same direction and at uniform angle of incidence in relation to the plane of the bridging portions. At a later stage the cut and formed sheet is wrapped around the two end frmaes so as to form a complete cage, the ends of the lugs are placed into the openings of the bridging portions and are heated, whereby they melt down around the openings and firmly lock the cage and the end frames.

In order to compensate for thermal expansion of the strips it is advisable—as known to the art—to firmly connect one end frame only to the casing, leaving the other frame freely movable in axial direction.

Around these basic components, i.e. the motor and impeller and the resistance heater, a casing of any size and design may be conceived, either as a wall-and ceiling fan heater, or as a free-standing room heater.

SHORT DESCRIPTION OF THE DRAWINGS

FIG. 1 is a cross section through a backplate, a motor and an impeller, and a resistance heater, forming the basic components of the electric heater of the invention, FIG. 2 is an enlarged longitudinal section through a portion of the resistance heater along line A—A of FIG. 1, FIG. 3 is a section along line B—B of FIG. 2, FIG. 4 is a cross section through a backplate, motor and impeller, and the resistance heater, showing shielding and cooling means for the electric motor, and an alternate heater fastening means, FIG. 5 is a cross section through a portable room heater and a support structure, incorporating the basic components of FIG. 1, FIG. 6 is a frontal view of the room heater of FIG. 5 as indicated by arrows C—C, FIG. 7 is a cross section of a wall heater incorporating the basic components of the heater of FIG. 1, FIG. 8 is a cross section of a room heater, wherein the basic components are incorporated in a casing of larger size, FIG. 9 is a plan view of part of a sheet of a resistance alloy, stamped out in the shape of the longitudinal strips and the bridging portions, FIG. 10 is a section through part of the resistance heater, showing terminals and electric control components fastened to one of the end rings, and FIG. 11 is an enlarged longitudinal section along line D—D of FIG. 4, showing additional means for securing the heater strip to the end rings.

DESCRIPTION OF THE PREFERRED EMBODIMENTS

Figure 1:
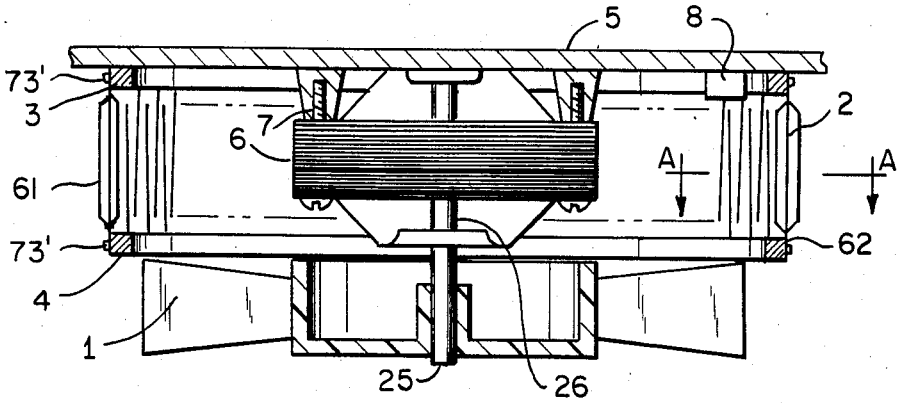
Figure 2:
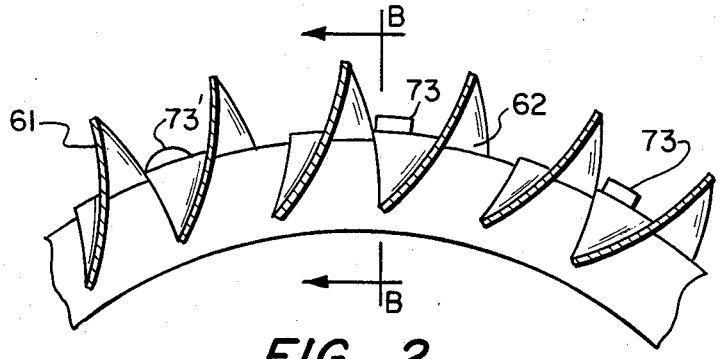
Figure 3:
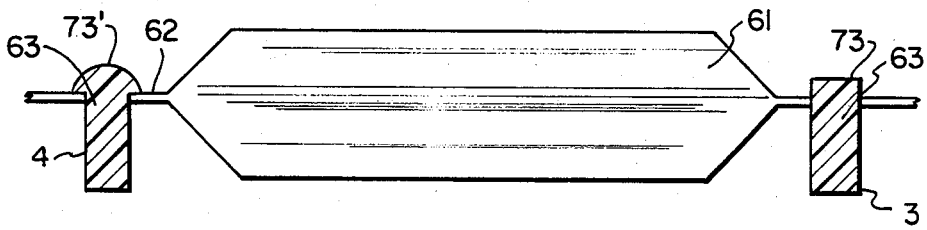

Referring now to FIGS. 1, 2, and 3 of the drawings, the basic components of the air heater consist of an axial impeller 1 mounted on the shaft 25 of an electric motor 6, a resistance heater 2 in the shape of a cylindrical cage, and a back plate 5. The motor 6 is attached to the back plate by bolts 7.

The resistance heater consists of a plurality of parallel curved strips 61, all inclined at the same angle of incidence and interconnected at alternate ends by flat bridging portions 62. Each bridging portion is perforated by a rectangular opening 63, and these heater components are cut out of a whole sheet of a resistance alloy and bent into cylindrical shape. The cylinder is supported at its both ends by two end rings 3 and 4 of a thermoplastic material which contain a plurality of outstanding lugs 73 located on their periphery at distances corresponding to the distances between the openings 63 in the bridging portions, and of a cross section permitting their insertion into these openings, one after the other.

After interlocking of the openings and the lugs, the tops of the latter are heated and molten down onto the bridging portions around the openings, as can be seen on the left hand side of FIGS. 2 and 3.

FIG. 1 shows that only one of the end rings (3) is fastened to the back plate, while the second end ring is free to move in axial direction, in order to prevent stresses in the strips 61 owing to thermal expansion. A thermostatic limit switch 8 is seen to be attached to the backplate.

Figure 4:
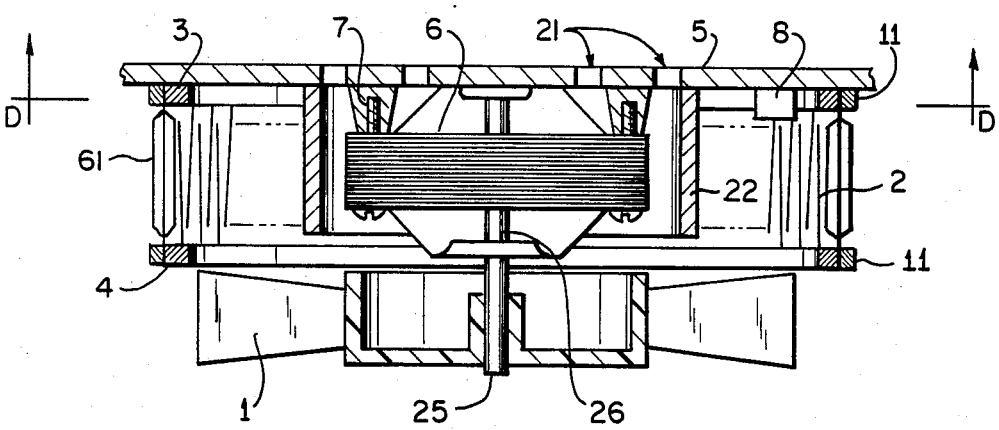

FIG. 4 illustrates a similar assembly as FIG. 1, with the addition of a cylindrical guard 22 positioned around the motor 6 and attached to the back plate. The guard protects the motor and its bearings 26 against overheating by the air heated on its passage through the heater strips 61; the motor is additionally cooled by ambient air entering through several openings 21 provided in the back plate, the air being drawn in by the suction of fan 1. It will be understood that, while fastening this kind of fan to a wall or ceiling, a gap is to be left between the back plate and the wall surface permitting air to reach the openings 21.

FIG. 4 also shows a secondary ring 11 which serves to secure the heater cage to rings 3 and 4.

Figure 5:
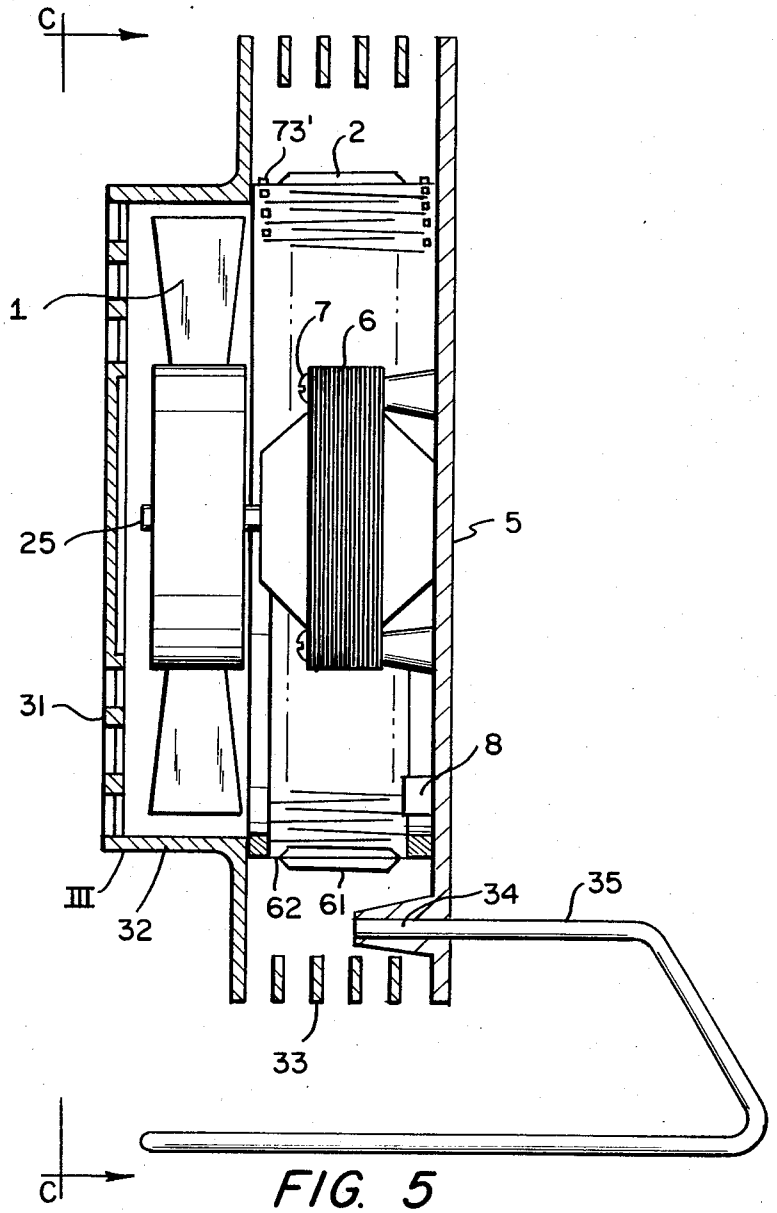
Figure 6:
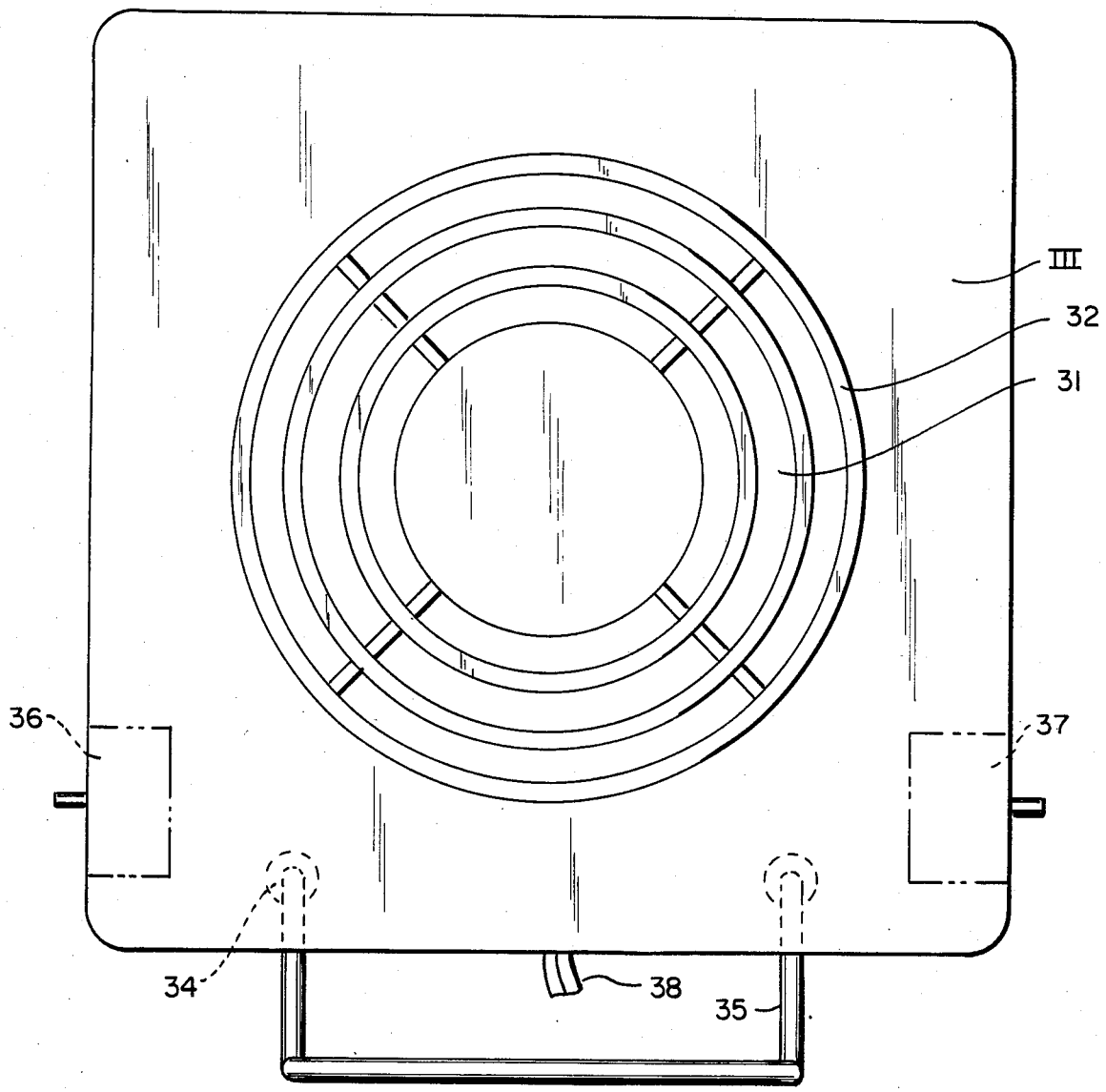

The basic components illustrated in FIGS. 1, 2, and 3, are incorporated in the room heater shown in FIGS. 5 and 6, with the addition of a frontal casing III, serving to shield the heating element and the fan impeller from contact by the user. The casing is attached to the back plate 5 and comprises a tubular fan shroud 32 closed at its front by a grille 31 in the shape of concentric rings, and an air inlet portion in form of annular, parallel spaced fins 33 which surround the heater cage at a distance.

A metal support 35 serves to support the casing at a distance from the floor and is attached to the back plate by means of two sleeves 34, which also permit the support to be separated from the heater whenever necessary.

FIG. 6 shows the arrangement of the electric control equipment in the casing (in broken lines), viz. a thermostatic switch 36, a multi-stage switch 37, and the electric connection to a power cord 38.

Figure 7:
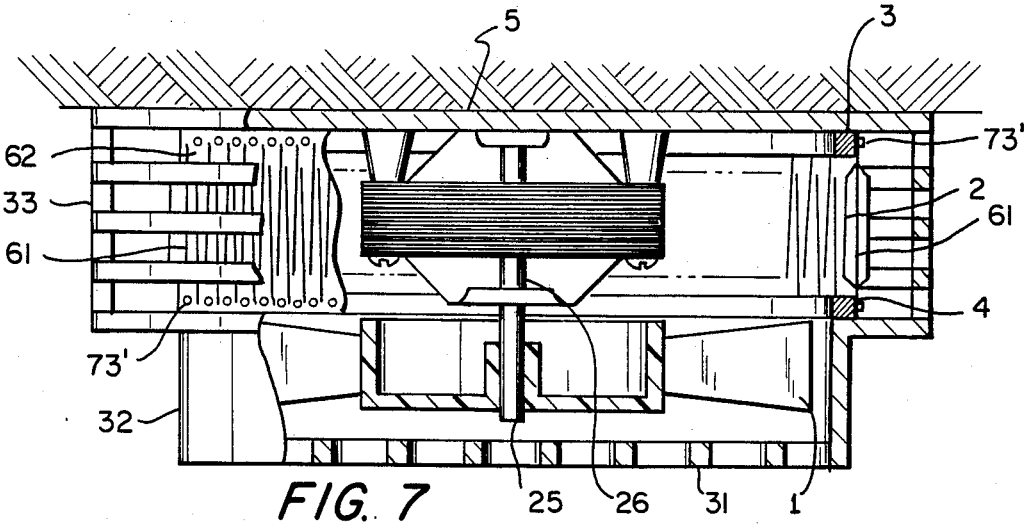

FIG. 7 illustrates a heater the casing of which is similar to that shown in FIGS. 5 and 6, but attached to a wall or ceiling. It will be noted that both the inlet and the outlet grilles are slightly different in design from those illustrated in FIGS. 5 and 6, but that the basic components are identical in both cases.

Figure 8:
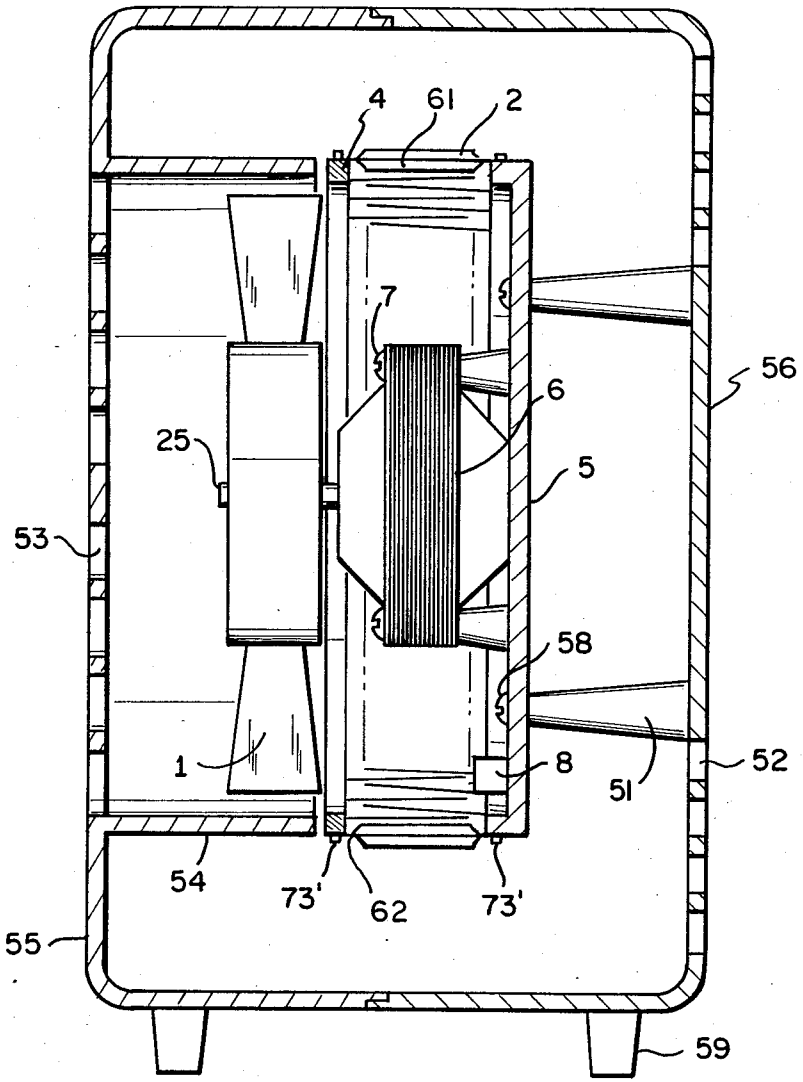

FIG. 8 is a vertical section through a room heater of larger dimensions which, again, incorporates the basic components of FIG. 1. Herein the casing is composed of two halves, a front part 55 and a rear part 56, connected along their circumferential portions. The front part has a flat face which is perforated by outlet openings 53, while the flat rear wall of the rear part is perforated by air inlet openings 52. A fan shroud 54 forms part of the front portion and extends from the front wall to the end ring 4 of the heater cage, leaving only a small circular gap between these parts permitting axial expansion of the cage. The back plate 5 also serves as a heater support ring and is fastened to the rear wall of the casing by posts 51 and screws 58. Legs 59 support the casing on the floor.

Figure 10:
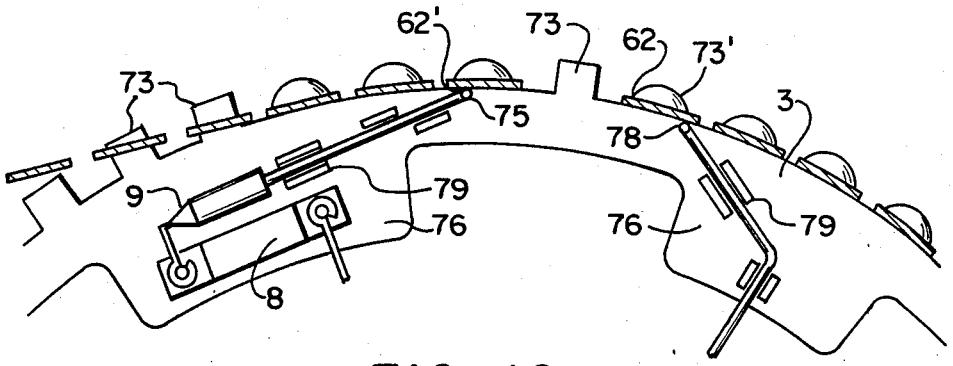
Figure 9:
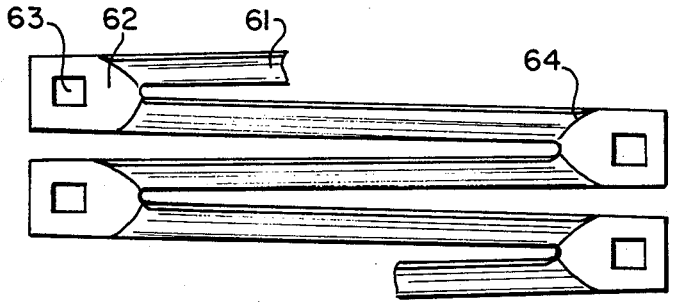

FIGS. 9 and 10 illustrate details of the resistance heater and its assembly. FIG. 9 shows several conductive strips 61 connected by bridging portions 62 as they appear after stamping and forming from a flat sheet of a resistance alloy.

The bend lines 64 are created by the twisting and forming of the strips 61 out of the plan in which the bridging portions 62 remain.

The bridging portions 62 are of much larger cross section than the conductive strips 61, resulting in a lower temperature; the cross sections of both the strips and the bridging portions are to be designed so that the temperature of the latter does not affect the material of the end rings. A rectangular opening 63 perforates each bridging portion which serve as anchors for the lugs 73 positioned on the respective peripheries of the end rings.

FIG. 10 illustrates the assembly of the cage on the end rings 3 and 4. In order to facilitate the assembly, the two rings are preferably mounted—during assembly only—at their correct distance on a rotatable structure, whereby the position of the lugs 73 is staggered in respect to the two rings so as to conform to the position of the openings 63 in the bridging portions as shown in FIG. 9. In order to start the assembly the two first bridging portions at the end of a—still planar—cage are placed with their openings on a pair of lugs on the two spaced rings, and the lugs are melted down on the metal as indicated by the numeral 73'. The process is continued, the cage strip is gradually bent around the rings and the heads of all the following lugs are similarly melted, firmly connecting the cage to the rings. FIG. 10 also illustrated the arrangement of the electric connections to the both ends of the cage. For this purpose one of the two end rings is provided with two inwardly extending ears 76 which are provided with clamping means for the electric leads in the form of parallel spaced ribs 79.

A thermostatic limit switch 8 in series with a thermofuse 9 are fastened to one of the ears and connected to one end portion 62' and to a lead 75 by opposite terminals, while a second lead 78 is connected to the other end portion 62. The two leads are, in a know manner, connected to a switch which energizes both the heating element and the fan motor.

Figure 11:
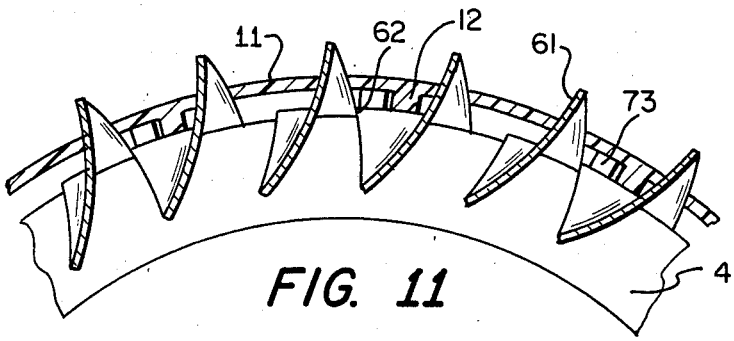

FIG. 11 illustrates yet additional means for securing the heater strip to the end rings. The basic end ring 4 is similar to the rings shown in FIGS. 1, 2 and 3, and so is the heater strip as illustrated in FIG. 9. In order to retain the strip in its place an outer ring 11 featuring internal teeth 12 is placed over the end ring 4 so that the internal teeth 12 firmly hold the bridging portions 62 between the rings 4 and 11.

It will be understood that the basic components as well as the casing may undergo variations and modification at the hands of a person skilled in the art without, however, deviating from the spirit of the invention and the scope of the offended claims.

For instance, the cage need not be a circular cylinder, it might be an elliptical or square cylinder or not even a complete cylinder as long as the void portion is blocked by means of a solid wall.

The back plate is not necessarily of planar configuration, but may be designed in a manner suitable for incorporation in a specific casing as long as suitable connection points are provided for the attachment of the motor and the heating element.

I claim:

1. An electric forced-convection air-heater consisting of an axial fan in the form of an electric motor and an axial fan impeller mounted on the shaft of said motor, an electric resistance heater in the shape of a cage mounted on a common base with said fan, upstream of said fan impeller in coaxial alignment therewith in a manner permitting air to be drawn by said fan impeller through said cage and to be heated by said resistance heater, the inclination of the vanes of said fan serves to create an initial vortex to the air before its entry into the impeller, and means for electrically energizing said motor and said resistance heater, wherein said cage-shaped resistance heater consists of a plurality of spaced longitudinal strips of an electric resistance alloy, of substantially uniform width extending substantially parallel to the axis of said fan, the surface of each strip forming an angle with a tangent to the periphery of said cage, said strips being held in a predetermined angle of inclination by conductive bridging portions of the same material but of a larger cross section than said strips, said bridging portions jointing the alternate ends of each of two proximate strips so as to form a resistor circuit in a zig zag pattern, said cage being held in shape and position by two supporting frames of a heat-resistant and non-conductive material, one frame each being firmly connected to all bridging portions at one end of said cage, and holding said bridging portion in spaced-apart electrically insulating alignment.

2. The electric heater of claim 1 wherein said cage is of cylindrical configuration of a larger inner diameter than said fan impeller, and wherein said supporting frames are of a circular annular shape.

3. The electric heater of claim 1 wherein one of the two supporting frames also serves as a mounting plate for said fan.

4. An electric forced-convection air heater consisting of a casing comprising a rear portion, a front portion provided with air outlet openings, and a peripheral portion provided with air inlet openings, an axial fan positioned inside said casing in coaxial alignment, comprising an electric motor and an axial fan impeller mounted on the shaft of said motor downstream of said air inlet openings in said casing, an elctric resistance heater in the shape of a cylindrical cage fastened inside said casing in coaxial alignment, said cage being of larger crossection than said impeller and comprising a plurality of spaced longitudinal strips of an electric resistance alloy in sheet form, serving both as heating elements and as air guide vanes, of substantially uniform width extending substantially parallel to the longitudinal axis of said cage, the surface of each strip forming an angle with a tangent to the cylindrical periphery of said cage, said strips being held in a predetermined angle of incidence by conductive bridging portions of the same material but of larger cross section than said strips, said bridging portions jointing the alternate ends of each two proximate strips so as to form a resistor circuit in a zigzag pattern, at least a portion of said bridging portions being provided with cut-outs and all bridging portions at both ends of said cage being positioned in common cylindrical planes in spaced alignment, ring shaped supports for the two ends of said cage shaped resistance-heater of a non-conductive and heat resistant material firmly connected to said bridging portions by means of said cut-outs in said bridging portions, means for electrically energizing said axial fan to cause air to flow through said resistance heater and through said casing into the surroundings to be heated, and means for electrically energizing said resistance heater to a temperature adequate for heating the air passing through said impeller.

5. The electric air heater of claims 1 or 4 wherein said conductive strips of said cage are curved in a direction perpendicular to their long axis so as to improve the air flow between said strips to said impeller and to increase the rigidity of said strips.

6. The electric air heater of claim 4 wherein said ring shaped supports consist of one ring each of an outside diameter coextensive with the common cylindrical plane formed by said bridging portions and provided along its circumference with outstanding lugs corresponding in size and location to said cut-outs in said bridging portion, serving to locate and secure said cage by interlocking with said cutouts.

7. The electric air heater of claim 4 wherein said two end rings are of a thermoplastic material and wherein at least a portion of said outstanding lugs are enlarged at their outer ends after assembly by heating and melting, so as to firmly hold said bridging portions in exact position.

8. The electric air heater of claim 4 wherein each of said bridging portions is perforated by said cut-outs, and wherein said two end rings are provided with one outstanding lug each to interlock with the corresponding cut-outs.

9. The electric air heater of claim 4 wherein a first end ring is rigidly fastened to said casing, and wherein the second ring is free permitting axial expansion of said conductive strips due to temperature changes.

10. The electric air heater of claim 4 wherein said conductive strips and said bridging portions are integrally formed from a single sheet of a resistance alloy sheet.

11. The electric air heater of claim 4 wherein said rear portion of said casing is in the form of a solid backplate serving both for attachment of said electric motor and of said first end ring of said cage.

12. The electric air heater of claim 4 wherein said electric motor is laterally surrounded by a cylindrical shroud in order to protect it against heating by the hot air, and wherein said back plate is provided with perforations extending into the space inside said shroud, permitting ambient air to be drawn into said shroud cooling said electric motor.

13. The electric air heater of claim 10 wherein a frontal casing is attached to said back plate provided with peripheral air inlet openings in the form of annular, parallel spaced fins and with concentric air outlet openings facing said fan impeller downstream thereof.

14. The electric heater of claim 4 wherein at least one of said end rings of the resistance heater is provided with inwardly extending ear, serving to support a thermostatic limit switch, a thermo-fuse, and the leads carrying electric current to the terminals of said cage.

* * * * *